United States Patent [19]

Notohamiprodjo

[11] Patent Number: 4,658,201

[45] Date of Patent: Apr. 14, 1987

[54] OUTPUT CIRCUIT FOR DIODE-OR CONNECTED POSITIVE THREE TERMINAL VOLTAGE REGULATORS

[75] Inventor: Hubertus S. Notohamiprodjo, Hoffman Estates, Ill.

[73] Assignee: GTE Communication Systems Corporation, Phoenix, Ariz.

[21] Appl. No.: 814,938

[22] Filed: Dec. 30, 1985

[51] Int. Cl.[4] ..... G05F 1/614

[52] U.S. Cl. ..... 323/224; 323/266; 323/269

[58] Field of Search ..... 323/265, 268, 269, 273, 323/277, 350, 224, 266

[56] References Cited

U.S. PATENT DOCUMENTS 4,074,182 2/1978 Weischedel ..... 323/269

FOREIGN PATENT DOCUMENTS 0214926 12/1984 Japan ..... 323/265

OTHER PUBLICATIONS

Haws; "Improving Integrity of Dualled Power Supply Monitoring"; May 15, 1979; New Electronics p. 48.

Nelson; "3-Terminal Regulators Work in Parallel Yet Retain Good Load Regulation"; Dec. 20, 1980; Electronic Design; p. 102.

*Primary Examiner*—Patrick R. Salce

*Assistant Examiner*—Jeffrey Sterrett

*Attorney, Agent, or Firm*—Gregory G. Hendricks; Robert J. Black

[57] ABSTRACT

An output circuit for diode-or connected positive three terminal voltage regulators. A voltage divider develops a voltage signal representative of the output voltage from the positive three terminal regulator. An adjustable precision shunt regulator connected to the voltage divider provides a control signal representative of the variance of the voltage signal from a predetermined threshold signal. The positive three terminal voltage regulator provides a variable output voltage in response to and representative of the control signal.

7 Claims, 2 Drawing Figures

OUTPUT CIRCUIT FOR DIODE-OR CONNECTED POSITIVE THREE TERMINAL VOLTAGE REGULATORS

FIELD OF THE INVENTION

The present invention relates to power supply circuits and more particularly to a control circuit for diode-or connected positive three terminal voltage regulators.

BACKGROUND OF THE INVENTION

A plurality of diode-or connected positive three terminal voltage regulators can be connected to a load in order to provide reliability through redundancy. However, when a diode is connected between the load and the output of a positive three terminal voltage regulator, the voltage regulation provided by such a regulator deteriorates. These regulators always maintain 1.25 volts between their output terminal and their adjustment terminal. As the load increases, however, the voltage drop across the diode connected between the load and the positive three terminal voltage regulator increases. Consequently the voltage available to the load decreases as does the voltage across a monitoring voltage divider.

The resultant signal from the voltage divider indicates a drop in output voltage. This signal causes the positive three terminal voltage regulator to increase its output voltage and as the output voltage increases so does the voltage drop across the diode. Therefore, in order to maintain 1.25 volts between the output and adjustment terminals the voltage across the voltage divider resistor decreases further since the diode and voltage divider resistor are series connected across the output and adjustment terminals. This decrease in voltage across the voltage divider resistor causes the positive three terminal voltage regulator to increase its output voltage even further until ultimately the regulator is completely out of regulation.

The output circuit of the present invention overcomes the out-of-regulation condition resulting from diode-or connected positive three terminal voltage regulators. This output circuit provides a highly regulated output when positive three terminal voltage regulators are connected to each other in a diode-or arrangement.

SUMMARY OF THE INVENTION

In accordance with the present invention, an output circuit is provided for use with three terminal regulators connected in a power system including a power source, a load and a plurality of diodes connected to said load and each associated with a different one of said regulators, each regulator having input output and adjustment terminals. The input terminal is connected to the power source and the output terminal is connected to the load via the associated diode.

The output circuit comprises a first voltage divider connected across the load and including first and second series connected impedance means operated to provide divider voltages of first and second characteristics, respectively, and control means connected between the voltage divider and the adjustment terminal. The control means is operated in response to the divider voltage of a first characteristic to provide a control signal of a first characteristic; and the regulator is operated in response to the control signal of a first characteristic to provide an output voltage of a first characteristic.

The first impedance means is further operated to provide a plurality of divider voltages less than said divider voltage of a first characteristic, and the control means is further operated in response to the plurality of the divider voltages less than said voltage of a first characteristic to provide a corresponding plurality of control signals of different characteristics. The regulator is further operated in response to the plurality of control signals of different characteristics to provide a corresponding plurality of output voltages of different characteristics.

DESCRIPTION OF THE PREFERRED EMBODIMENT

Figure 1:
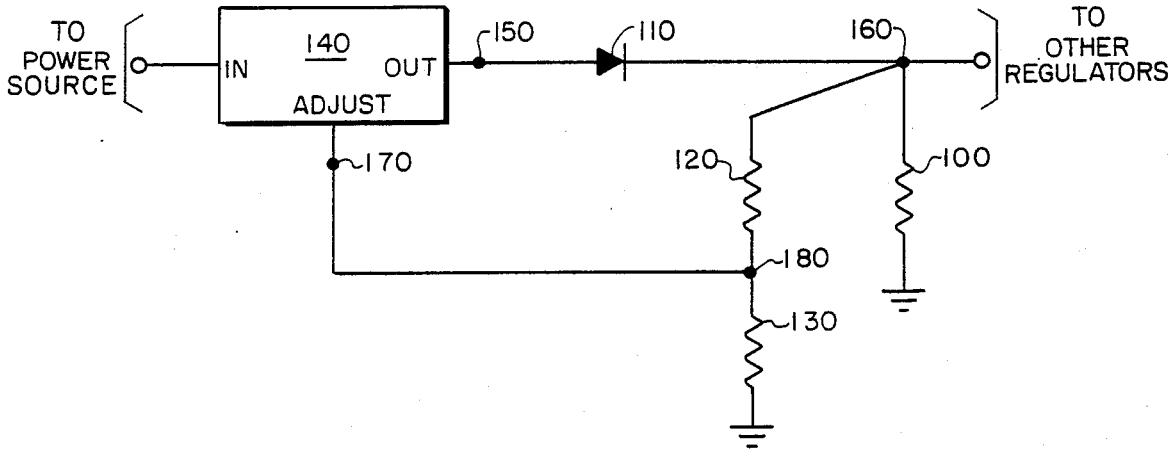
FIG. 1 (PRIOR ART)
FIG. 1 is a schematic diagram of a prior art positive three terminal voltage regulator with a diode output for connection in a diode-or arrangement.

Referring now to FIG. 1 a prior art version of a positive three terminal voltage regulator is shown connectable to a power source. This prior art regulator is connected to load 100 via output diode 110 and load 100 is further connected to the ground. Diode 110 and resistors 120 and 130 are used in order to allow multiple positive three terminal voltage regulators to be connected to a common load thereby providing reliability through redundancy.

Adjustable positive three terminal voltage regulator 140 is shown connectable to a power source. This voltage regulator is also connected via output terminal 150 to the anode of diode 110. The cathode of this diode is connected to load 100 and to resistor 120 at junction point 160. Adjustment terminal 170 of regulator 140 is connected to resistors 120 and 130 at junction point 180. Resistor 130 is further connected to the ground.

When voltage regulator 140 is connected to the power source it provides an output voltage at output terminal 150. This output voltage then causes current to flow through load 100 via diode 110. Voltage Regulator 140 is commercially available and is typically referred to as an LM317 adjustable three terminal voltage regulator by commercial semiconductor suppliers such as Motorola, National Semiconductor, RCA, etc. This commercial voltage regulator provides a constant 1.25 volts between output terminal 150 and adjustment terminal 170.

As the load increases current flow from voltage regulator 140 through diode 110 also increases. Consequently, the voltage drop across this diode increases, and since voltage regulator 140 maintains a constant 1.25 volts between its output terminal 150 and its adjustment terminal 170, the voltage across resistor 120 decreases. Therefore, the current flow through this resistor also decreases. In order for the voltage across the series combination of resistors 120 and 130 to remain equal to the voltage across parallel connected load 100, the voltage across resistor 130 must increase.

Therefore, more current is drawn from adjustment terminal 170 of voltage regulator 140 in order to provide that increased voltage across resistor 130. Consequently, voltage regulator 140 increases its output and the voltage across diode 110 continues to increase causing the voltage across resistor 120 to continue to decrease. This causes more current to again be drawn from adjustment terminal 170 of voltage regulator 140 and it continues to increase its output until ultimately it goes out of regulation altogether.

Figure 2:
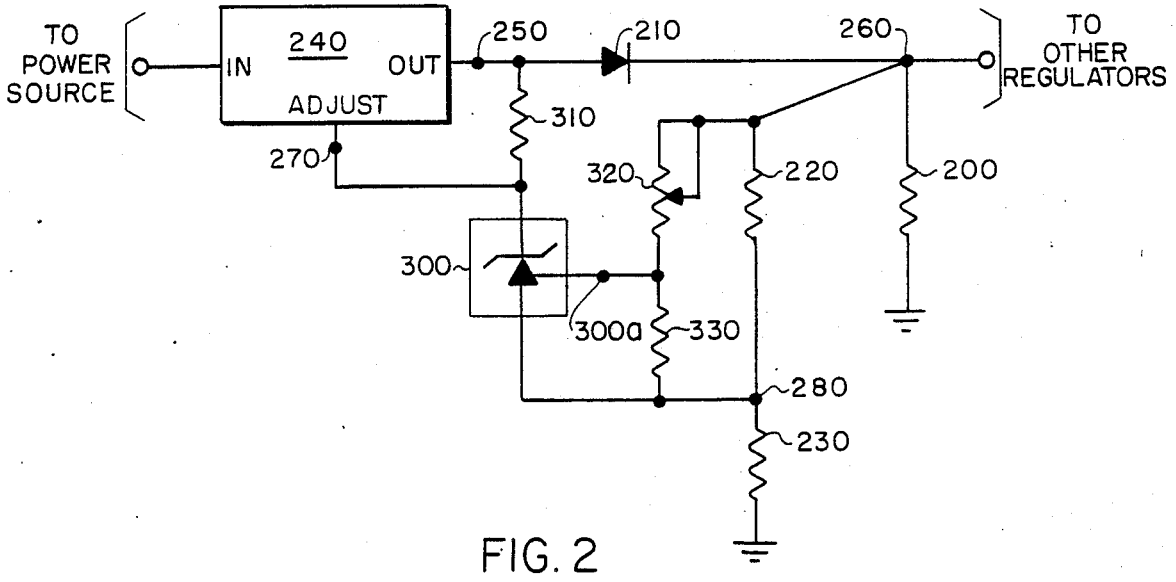
FIG. 2 is a schematic diagram of a positive three terminal voltage regulator with a diode output for connection in a diode-or arrangement in accordance with the present invention.

Referring now to FIG. 2 the output circuit for diode-or connected positive three terminal regulators of the present invention is shown. This circuit overcomes the out-of-regulation condition resulting from the prior art arrangement of connecting multiple three terminal positive voltage regulators to a load in a diode-or arrangement. The output circuit for diode-or connected three terminal positive voltage regulators of the present invention is shown connected to load 200. This circuit is connectable to a power source and other regulators also. This circuit is similar to the prior art circuit of FIG. 1 in that it includes output diode 210 and voltage divider resistors 220 and 230. However, the remainder of the output circuit of FIG. 2, in accordance with present invention, represents a novel departure from the prior art circuit.

Adjustable positive three terminal voltage regulator 240 is shown connectable to an external power source. This voltage regulator is also connected to the anode of output diode 210 via output terminal 250. The cathode of output diode 210 is connected to load 200 voltage divider resistor 220 at junction point 260. Adjustment terminal 270 of voltage regulator 240 is connected to the junction of adjustable shunt regulator 300 and current supply resistor 310. This current supply resistor is further connected to output terminal 250 of regulator 240 and the anode of shunt regulator 300 is connected to junction point 280 between voltage divider resistors 220 and 230.

Adjustable shunt regulator 300 includes an adjustment terminal 300*a* which is connected to the junction of voltage divider resistors 320 and 330. Voltage divider resistor 330 is further connected to junction point 280 and voltage divider resistor 320 is further connected to junction point 260. Adjustable shunt regulator 300 is a well known commercial device and is available from Texas Instruments as part number TL431C. Voltage divider resistor 320 is shown as a potentiometer; however, once the appropriate resistance is determined, a fixed value resistor can be substituted for that potentiometer.

Current supply resistor 310 is chosen to supply 1 ma–100 ma to shunt regulator 300 and also to maintain the voltage between output terminal 250 and adjustment terminal 270 of voltage regulator 240 at 1.25 volts. The value of this resistor would typically be 2000 ohms.

The value of voltage divider resistor 220 is chosen such that the voltage across this resistor is greater than the minimum threshold voltage of shunt regulator 300. This threshold voltage is typically 2.5–2.75 volts. For example, in order to have a 12 volt output at junction point 260, voltage divider resistors 220 and 230 might be selected to provide 4 volt and 8 volt drops, respectively. Voltage divider resistors 320 and 330 would be selected to have resistance values much larger than voltage divider resistors 220 and 230 in order to prevent resistors 320 and 330 from impacting the operation of resistors 220 and 230.

Similarly, voltage divider resistors 320 and 330 divide a voltage of 4 volts which appears between junction point 260 and junction point 280. Resistor 330 is selected to provide the threshold voltage of shunt regulator 300. This threshold voltage is typically 2.5 volts and therefore, resistors 320 and 330 should be selected to provide a 1.5 volt drop across resistor 320 and a 2.5 volt drop across resistor 330. In order to meet this 1.5/2.5 voltage ratio, resistors 320 and 330 must be selected to have resistance values that also correspond to that ratio. An example of such resistance values would be 600 ohms for resistor 320 and 1000 ohms for resistor 330. The total resistance for these resistors of 1600 ohms is more than ten times larger than the 100 ohm resistance of resistor 220. Therefore, the impact of resistors 320 and 330 on resistor 220 is negligible since very little current is drawn by these resistors as compared to the current drawn by resistor 220.

With this arrangement, when the load increases, the voltage drop across output diode 210 also increases. Therefore, the voltage drop across resistors 220 and 230 is reduced. When the voltage across resistor 220 is reduced, the voltage across resistor 330 is also reduced. Consequently, this resistor no longer provides the required threshold voltage to the adjustment terminal of shunt regulator 300. However, this shunt regulator will maintain its threshold voltage by drawing increased current from adjustment terminal 270 of voltage regulator 240. Voltage regulator 240 responds to this increased current drain at its adjustment terminal by providing an increased output voltage at output terminal 250. The output voltage appearing at that terminal will increase until the voltage across resistor 330 is equal to the threshold voltage of shunt regulator 300. Consequently, the output circuit of the present invention allows adjustable positive three terminal voltage regulators to be connected in a diode-or arrangement to a common load while maintaining a highly regulated voltage across that load.

It will be obvious to those skilled in the art that numerous modifications of the present invention can be made without departing from the spirit of the invention which shall be limited only by the scope of the claims appended hereto.

What is claimed is:

1. An output circuit for use with three terminal regulators connected in a power system including a power source, a load and a plurality of diodes connected to said load and each associated with a different one of said regulators, each regulator having input, output and adjustment terminals, said input terminal being connected to said power source and said output terminal being connected to said load via said associated diode, said output circuit comprising:

a first voltage divider connected across said load and including first and second series connected impedance means operated to provide divider voltages of first and second characteristics, respectively;

control means connected between said voltage divider and said adjustment terminal and operated in response to said divider voltage of a first characteristic to provide a control signal of a first characteristic;

said regulator being operated in response to said control signal of a first characteristic to provide an output voltage of a first characteristic;

said impedance means being further operated to provide a plurality of divider voltage less than said divider voltage of a first characteristic;

said control means being further operated in response to said plurality of divider voltages less than said voltage of a first characteristic to provide a corresponding plurality of control signals of different characteristics;

said regulator being further operated in response to said plurality of control signals of different characteristics to provide a corresponding plurality of output voltages of different characteristics; and said control means comprising a second voltage divider connected across said first impedance means and operated to provide a threshold voltage and a plurality of voltage less than said threshold voltage; and comparison means comprising an adjustable precision shunt regulator connected between said second voltage divider and said adjustment terminal and operated in response to said threshold voltage to provide said control signal of a first characteristic and further operated in response to said plurality of voltages less than said threshold voltage to provide said plurality of control signals of different characteristics.

2. An output circuit as claimed in claim 1, wherein said comparison means further comprises a current feed resistor connected between said output terminal and said cathode.

3. An output circuit as claimed in claim 1, wherein said second voltage divider comprises third and fourth series connected impedance means.

4. An output circuit as claimed in claim 3, wherein said threshold voltage is developed across said fourth impedance means.

5. An output circuit as claimed in claim 4, wherein said third impedance means comprises a potentiometer.

6. An output circuit as claimed in claim 4, wherein said fourth impedance means comprises a resistor.

7. An output circuit as claimed in claim 3, wherein said adjustable precision shunt regulator includes anode, cathode and control terminals, said anode and control terminals being connected across said fourth impedance means, and said cathode terminal being connected to said adjustment terminal.

* * * * *